US010210990B2

(12) United States Patent
Chou et al.

(10) Patent No.: US 10,210,990 B2
(45) Date of Patent: Feb. 19, 2019

(54) TRANSFORMER STRUCTURE

(71) Applicants: LITE-ON ELECTRONICS (GUANGZHOU) LIMITED, Guangzhou (CN); LITE-ON TECHNOLOGY CORPORATION, Taipei (TW)

(72) Inventors: Tai-Chung Chou, Taoyuan (TW); Chi-Che Wu, Taipei (TW); Kuan-Yu Lin, New Taipei (TW); Yen-Yi Lee, Taoyuan (TW)

(73) Assignees: LITE-ON ELECTRONICS (GUANGZHOU) LIMITED, Guangzhou (CN); LITE-ON TECHNOLOGY CORPORATION, Taipei (TW)

( * ) Notice: Subject to any disclaimer, the term of this patent is extended or adjusted under 35 U.S.C. 154(b) by 102 days.

(21) Appl. No.: 15/168,406

(22) Filed: May 31, 2016

(65) Prior Publication Data

US 2017/0271074 A1 Sep. 21, 2017

(30) Foreign Application Priority Data

Mar. 16, 2016 (CN) ..... 2016 2 0204179 U

(51) Int. Cl.

| | |
|---|---|
| ***H01F 27/30*** | (2006.01) |
| ***H01F 27/24*** | (2006.01) |
| ***H01F 17/04*** | (2006.01) |
| ***H01F 27/29*** | (2006.01) |
| ***H01F 27/28*** | (2006.01) |

(52) U.S. Cl.

CPC ..... *H01F 27/29* (2013.01); *H01F 27/2852* (2013.01); *H01F 27/2866* (2013.01); *H01F 27/306* (2013.01)

(58) Field of Classification Search

CPC .... H01F 27/29; H01F 27/2823; H01F 27/324; H01F 27/306; H01F 27/2866; H01F 27/2852; H01F 27/292; H01F 5/04; H01F 5/02; H01F 2005/046; H01F 2005/043; H01F 2027/2814; H01F 2027/2819; H01F 2027/2847; H01F 2027/297

USPC ..... 336/198, 208, 221, 212, 192, 170

See application file for complete search history.

(56) References Cited

U.S. PATENT DOCUMENTS 6,522,233 B1 * 2/2003 Kyoso ..... H01F 27/306 336/192

9,640,307 B2 * 5/2017 Miyamoto ..... H01F 5/02

(Continued)

*Primary Examiner* — Mang Tin Bik Lian

(74) *Attorney, Agent, or Firm* — Li & Cai Intellectual Property (USA) Office

(57) ABSTRACT

A transformer structure comprising a winding stand, a first coil, two second coils, and an iron core set. The first coil winds on the winding portion of the winding stand, and the first coil connects to the first pins electrically. The second coils are two metal sheets having electrical conductivity, the two second coils are provided with a ring body and two second pins respectively, the two second coils being arranged on the side edge of the winding portion of the winding stand. The iron core set is arranged on the winding stand, and the iron core set passes internally through the first coil and the two second coils. As a result, the DC resistance is decreased and the power consumption is reduced accordingly, improving the temperature rising problem.

7 Claims, 9 Drawing Sheets

(56) References Cited

U.S. PATENT DOCUMENTS

| | | | | |
|---|---|---|---|---|
| 2004/0257190 | A1* | 12/2004 | Peck | H01F 27/2847 336/212 |
| 2008/0180205 | A1* | 7/2008 | Tsai | H01F 27/2866 336/192 |
| 2010/0026437 | A1* | 2/2010 | Lin | H01F 27/2847 336/192 |
| 2010/0033282 | A1* | 2/2010 | Hsu | H01F 27/06 336/65 |
| 2011/0115598 | A1* | 5/2011 | Wu | H01F 27/325 336/212 |

* cited by examiner

TRANSFORMER STRUCTURE

TECHNICAL FIELD

The present disclosure relates to a transformer structure; specifically, it relates to a transformer structure applicable to electrical and electronic products.

BACKGROUND ART

Among the well-known electronic products, the power supply usually has to be transformed through a transformer to meet the appropriate drive power of each electronic component. The existing transformers comprise a winding stand, a first and second coil wound on the winding stand, and a set of iron core arranged on the winding stand. A well-known transformer can be applied to a power supply, but for power supplies with a high wattage, the transformer used therein will have the problems of power consumption and temperature rise.

In conclusion, considering that the defects can be improved, the inventor, focusing on researching and applying theories, finally put forwards an invention with a reasonable design to improve the defects effectively.

SUMMARY OF THE INVENTION

The technical problem to be solved by the present disclosure is to provide a transformer structure to reduce the DC resistance significantly so that the power consumption can be reduced accordingly and finally to improve the temperature rise problem.

To solve the technical problem, the present disclosure provides a transformer structure, comprising a winding stand, comprising a winding portion, a pin seat is arranged on a side of the winding portion, and a plurality of first pins are arranged on the pin seats; a first coil, wound on the winding portion of the winding stand, and the first coil connects to the first pins electrically; two second coils, being two metal sheets having electrical conductivity, the two second coils are provided with a ring body and two second pins respectively, the two second pins being connected to the ring body, the two second coils being arranged on the side edge of the winding portion of the winding stand; and an iron core set, arranged on the winding stand, and the iron core set passes internally through the first coil and the two second coils.

The instant disclosure has at least the following advantages:

The transformer structure of the present disclosure can reduce the transformer power consumption by reducing the Direct Current Resistance (DCR) of the secondary side coil of the transformer, resulting in improvements in both efficiency and the temperature rise problem. Additionally, the transformer according to the present disclosure can be further used with a power supply having a medium range of wattage in a limited space; the transformer according to the present invention can be used extensively in the field of power electronics.

In order to further understand the features and technical content of the present disclosure, reference can be made to the detailed description and accompanying drawings of the present disclosure. However, the accompanying drawings are only provided for references and illustration, but not intended to limit the present disclosure.

BRIEF DESCRIPTIONS OF THE DRAWINGS

DETAILED DESCRIPTIONS OF THE INVENTION

First Embodiment

Figure 1:
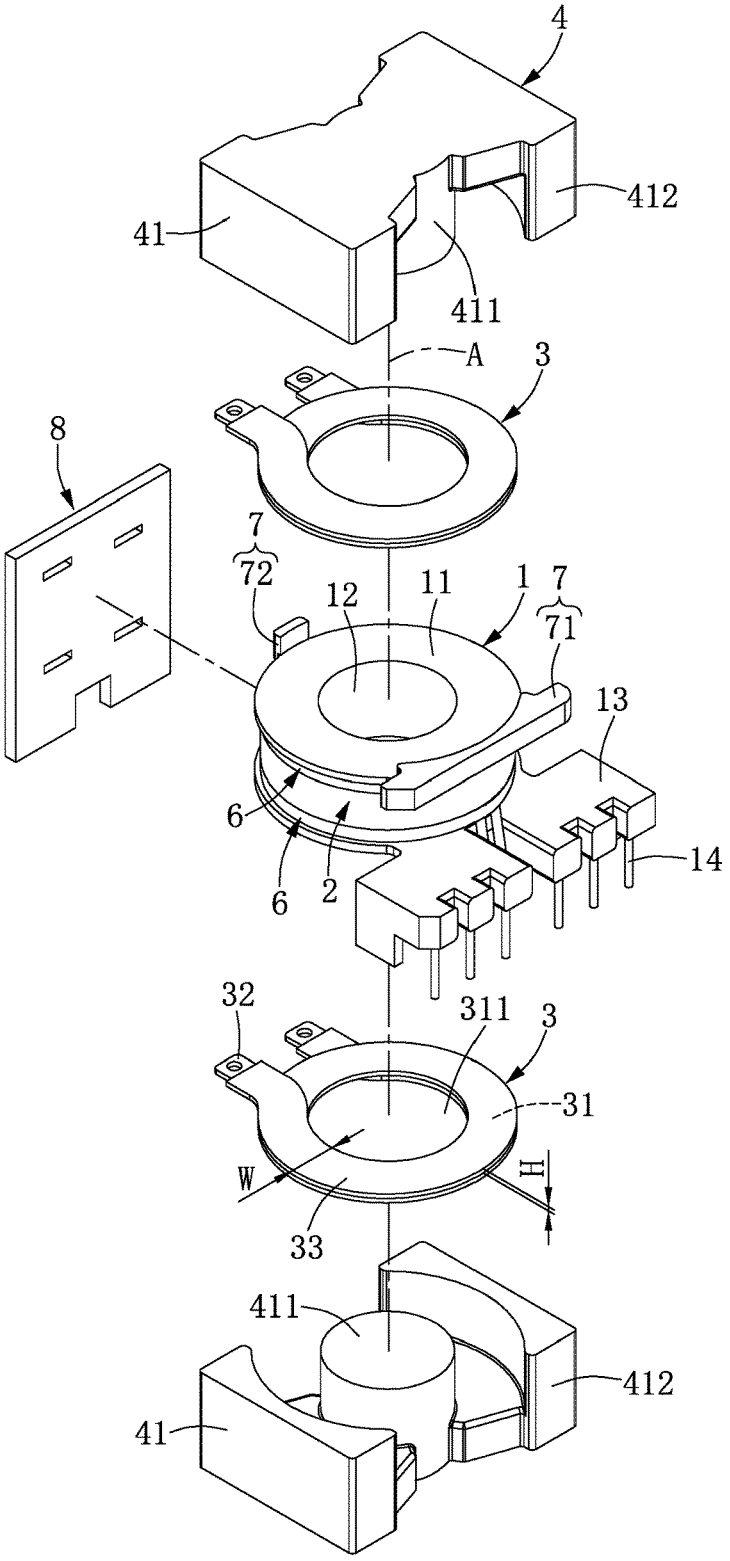
FIG. 1 is a three-dimensional breakdown drawing of the first embodiment according to the transformer structure of the present disclosure.
Figure 2:
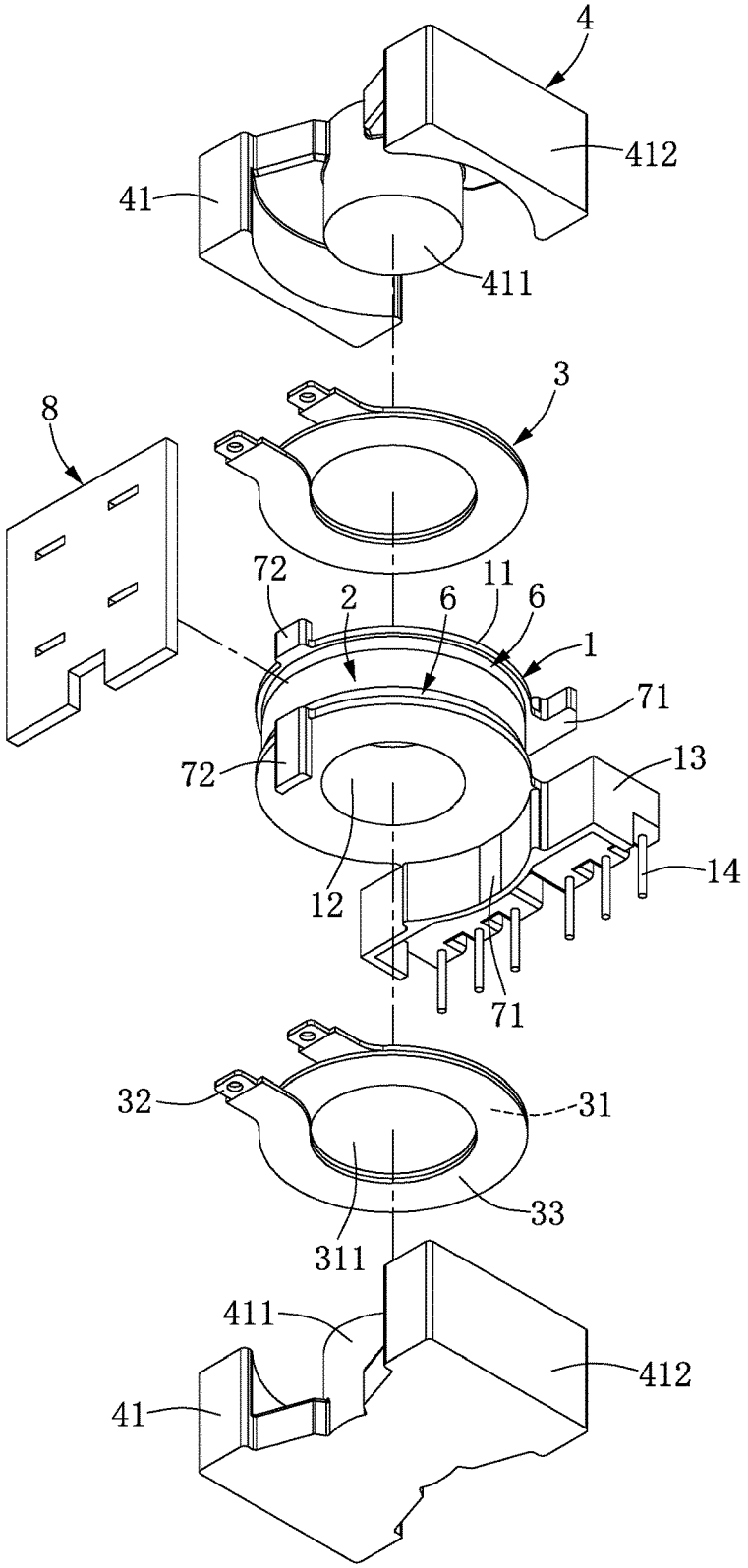
FIG. 2 is a three-dimensional breakdown drawing of the first embodiment from another angle according to the transformer structure of the present disclosure.

Please refer to FIG. 1 and FIG. 2. A transformer structure is provided in the present disclosure, comprising a winding stand 1, a first coil 2, two second coils 3, and an iron core set 4, wherein the winding stand 1 is made of insulating materials (such as plastics), the winding stand 1 is provided with a winding portion 11, the winding portion 11 is a hollow pipe body, and a first boring 12 is arranged inside the winding portion 11. A pin seat 13 is arranged on a side of the winding portion 11, a plurality of first pins 14 are arranged on the pin seat 13; the first pins 14 are made of metal materials with electrical conductivity, and these first pins 14 can be straight or in a bending shape, the shape of pins 14 is not limited. In the embodiment of the present invention, these first pins 14 are straight, and these first pins 14 are parallel to the pivot direction A of the winding stand 1. The structure of the winding stand 1 can change according to the specification requirements without limitation.

The first coil 2 winds on the winding portion 11 of the winding stand 1, and the first coil 2 connects to the pins 14 electrically; the first coil 2 may be optionally electrically connected to part of the first pins 14.

The second coil 3 is a metal sheet having electrical conductivity, preferably but not limited to a copper sheet (or a copper alloy sheet). The two second coils 3 are provided with a ring body 31 and two second pins 32 respectively. The ring body 31 of the second coil 3 is arranged and wound spirally. The ring body 31 can wind once, twice or more; preferably, the ring body 31 winds more than twice, but this does not limit the number of winding turns of the ring body 31. A first insulating layer 33 can be further arranged on the outer edge of the ring body 31, with the first insulating layer 33 being coated with the insulating material or the insulating material being electroplated on the outer edge of the ring body 31. A second boring 311 is arranged inside the ring body 31. The ring body 31 can be flat, i.e., the cross section of the ring body 31 is a rectangle, and the size of the width W of the cross section of the ring body 31 is larger than the size of the thickness H. Two second pins 32 are connected to the ring body 31, i.e., the two second pins 32 are connected to the two spirally-arranged ends of the ring body 31. The second pins 32 protrude from the outer edge of the ring body 31.

Two second coils 3 are arranged on the side edge of the winding portion 11 of the winding stand 1, i.e., the two second coils 3 can be arranged on the two opposite sides of the winding portion 11 of the winding stand 1 respectively. In the embodiment of the present disclosure, the winding portion 11 is a round, shallow pipe body, and the ring body 31 of the second coils 3 forms a corresponding round shape, enabling the two second coils 3 to be arranged correspondingly on the two opposite sides of the winding portion 11 of the winding stand 1; the second coils 3 are arranged on the outside of the winding portion 11 of the winding stand 1, rather than winding on the winding portion 11 of the winding stand 1. The second pins 32 of the second coils 3 protrude from the side edge of the winding stand 1. The second pins 32 may be perpendicular to the pivot direction A of the winding stand 1; i.e., the second pins 32 are perpendicular to the first pins 14. The second pins 32 and the first pins 14 protrude from different sides of the winding stand 1. The embodiment is a symmetrical assembling method of the primary and secondary sides, so that leakage inductances of the secondary sides may not differ from each other.

In addition, these second pins 32 can be further bended appropriately; for example, these second pins 32 may be bended to be perpendicular to the ring body 31 (not shown), so that the second pins 32 extend in the same direction of the first pins 14. This also means that the second pins 32 may be parallel to the pivot direction A of the winding stand 1 and the second pins 32 are parallel to the first pins 14, so that the second pins 32 and the first pins 14 may protrude from a side of the winding stand 1, making it convenient to be coupled to the circuit board. The second pins 32 may be further coupled to a sub-circuit board 8.

A positioning mechanism 7 may be further arranged between the side edge of the winding portion 11 of the winding stand 1 and the two second coils 3, to position the two second coils 3 on the side edge of the winding portion 11 of the winding stand 1, so that any looseness between the two second coils 3 and the winding stand 1 can be avoided. The positioning mechanism 7 can comprise a first positioning portion 71, arranged on the side edge of the winding portion 11; the first positioning portion 71 may be a board body or column body with one of its inner sides in the shape of an arc surface. The first positioning portion 71 may contact on one outer side of the second coil 3.

The positioning mechanism 7 can further comprise a second positioning portion 72, arranged on the side edge of the winding portion 11; the second positioning portion 72 may be a board body or column body with one of its inner sides in the shape of an arc surface. The second positioning portion 72 may contact on the other outer side of the second coil 3. The first positioning portion 71 and the second positioning portion 72 are arranged on the two sides of the outer edge of the second coil 3, thus the second coil 3 can be positioned steadily on the side edge of the winding portion 11 of the winding stand 1.

Furthermore, an insulating tape 6 is arranged at the outer edge of the winding portion 11, with the outer edge being close to the two second coils 3; i.e., the insulating tape 6 is taped and set on the two near sides of the outer edge of the winding portion 11 of the winding stand 1 respectively. The two insulating tapes 6 are arranged between the first coil 2 and the two second coils 3, to increase the insulating efficiency; and the variation in thickness of the insulating tapes 6 can be further used to adjust the distance between the first coil 2 and the second coils 3.

Figure 3:
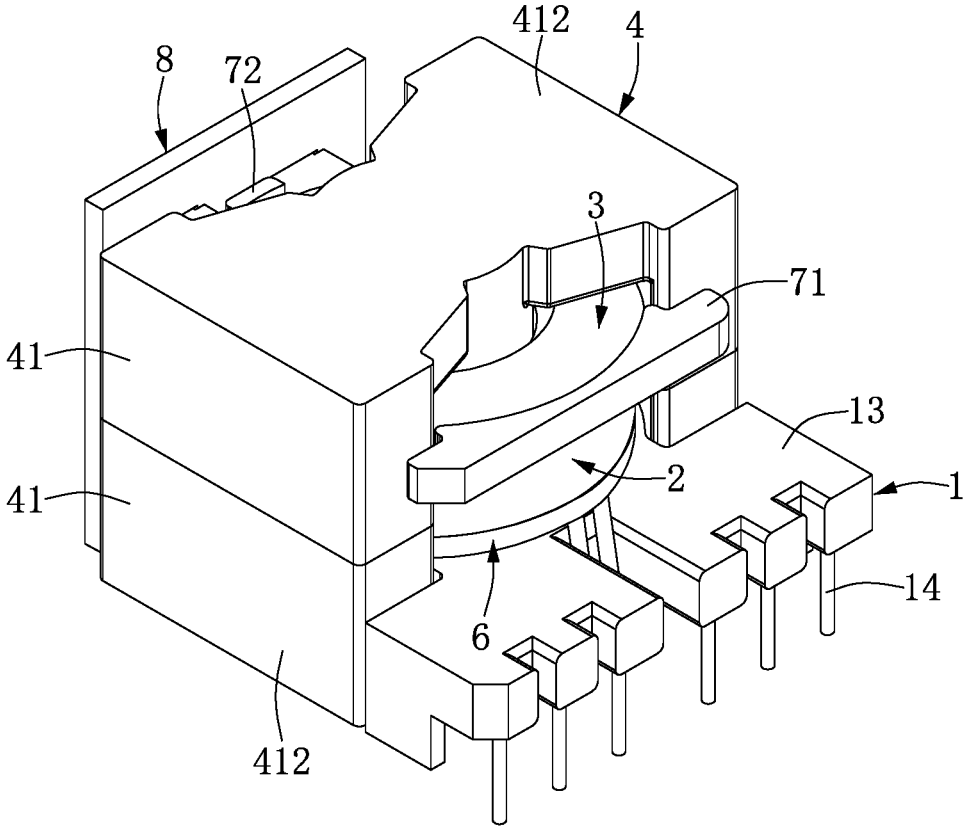
FIG. 3 is a three-dimensional assembly drawing of the first embodiment according to the transformer structure of the present disclosure.
Figure 4:
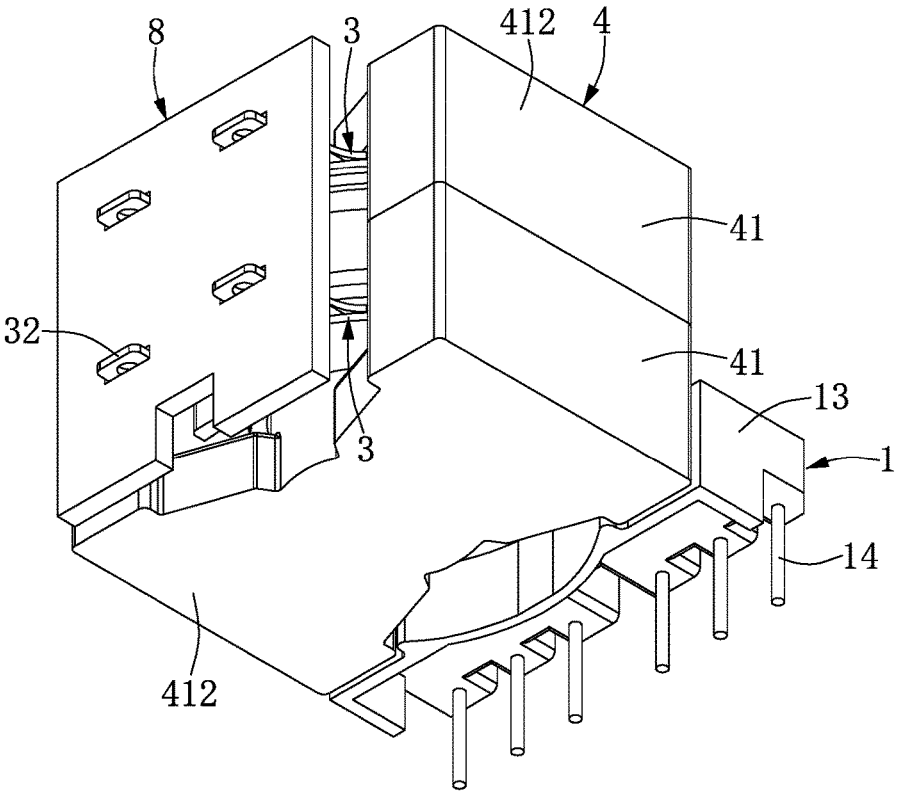
FIG. 4 is a three-dimensional assembly drawing of the first embodiment from another angle according to the transformer structure of the present disclosure.
Figure 5:
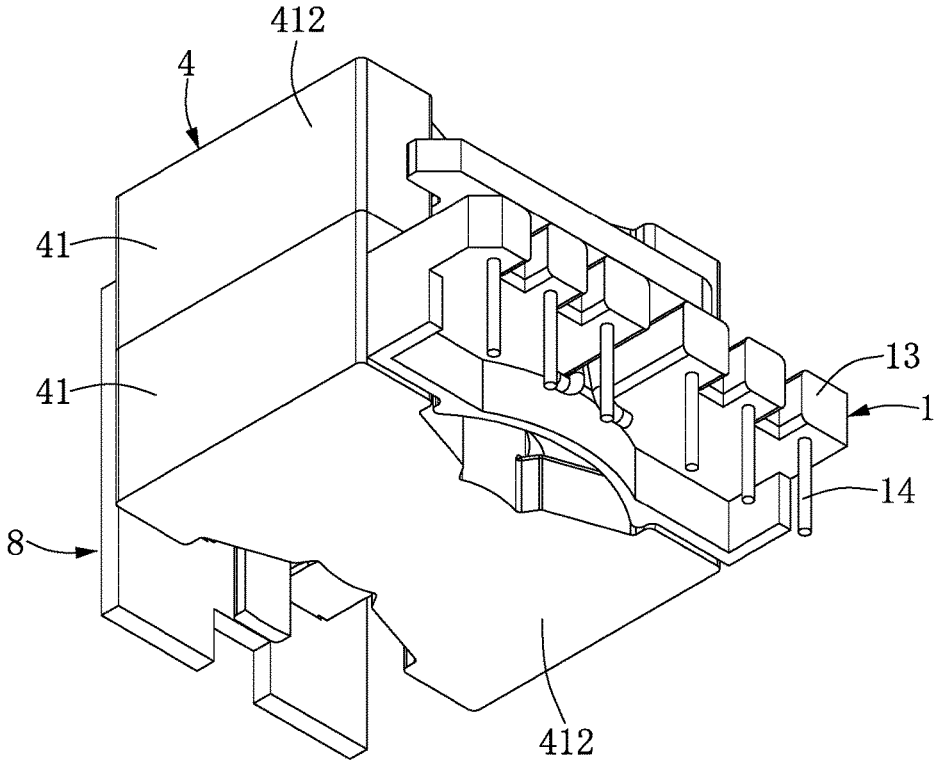
FIG. 5 is a three-dimensional assembly drawing of the first embodiment from a further angle according to the transformer structure of the present disclosure.
Figure 6:
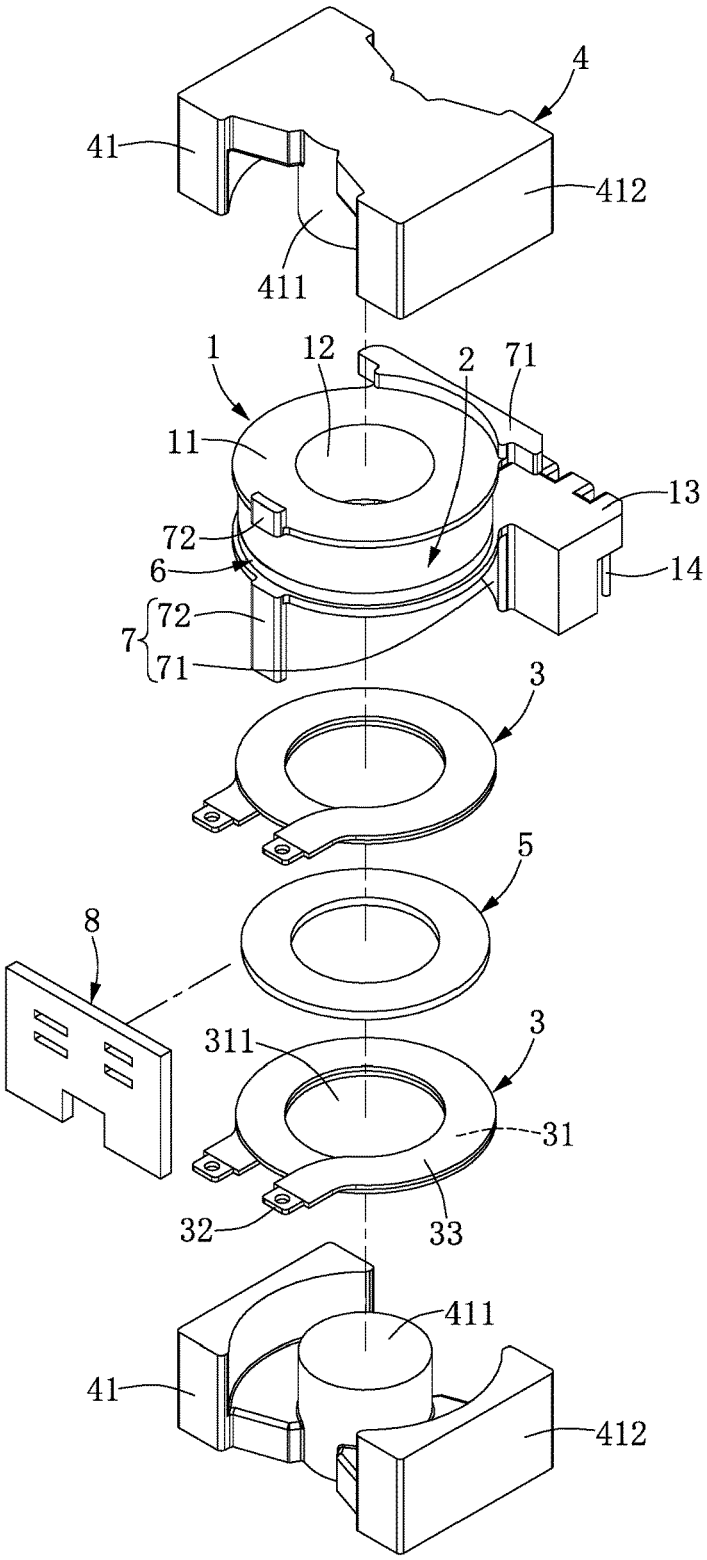
FIG. 6 is a three-dimensional breakdown drawing of the second embodiment according to the transformer structure of the present disclosure.
Figure 7:
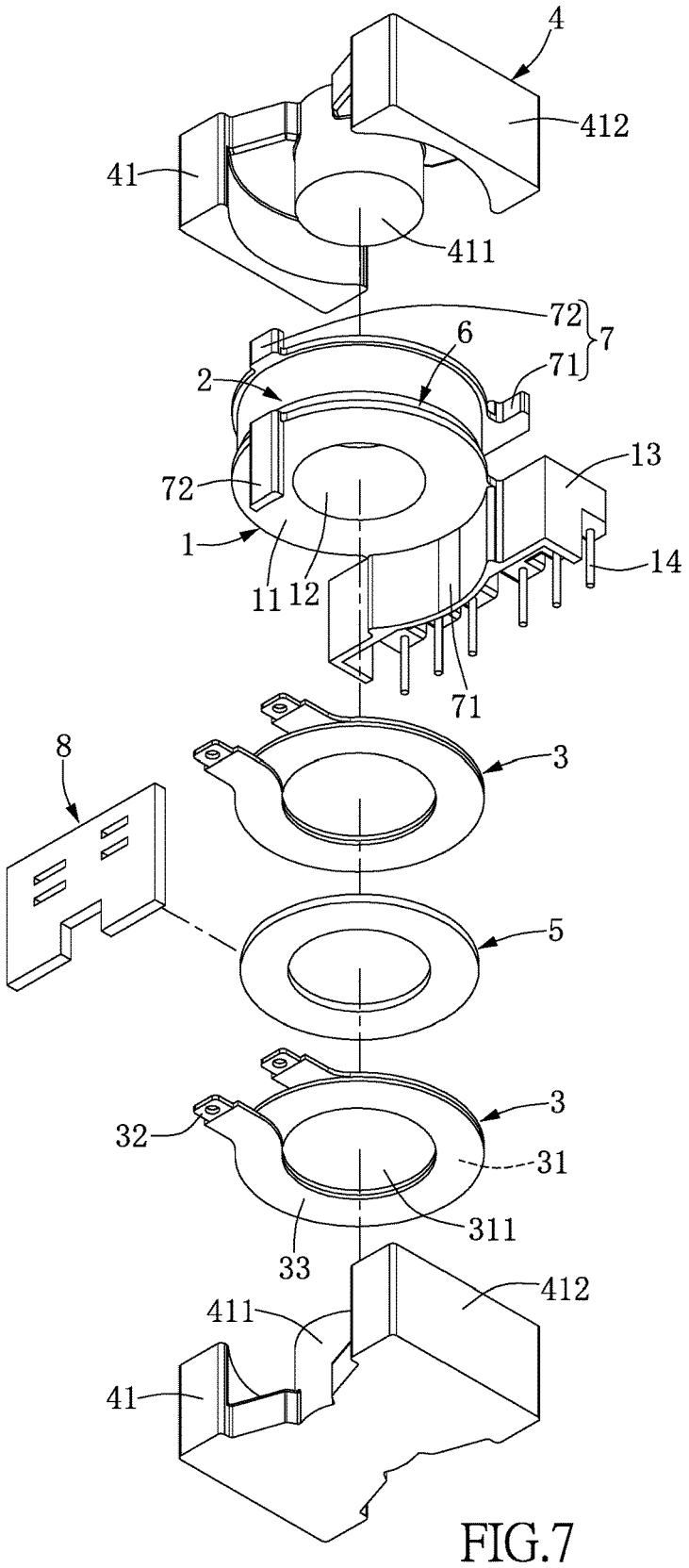
FIG. 7 is a three-dimensional breakdown drawing of the second embodiment from another angle according to the transformer structure of the present disclosure.
Figure 8:
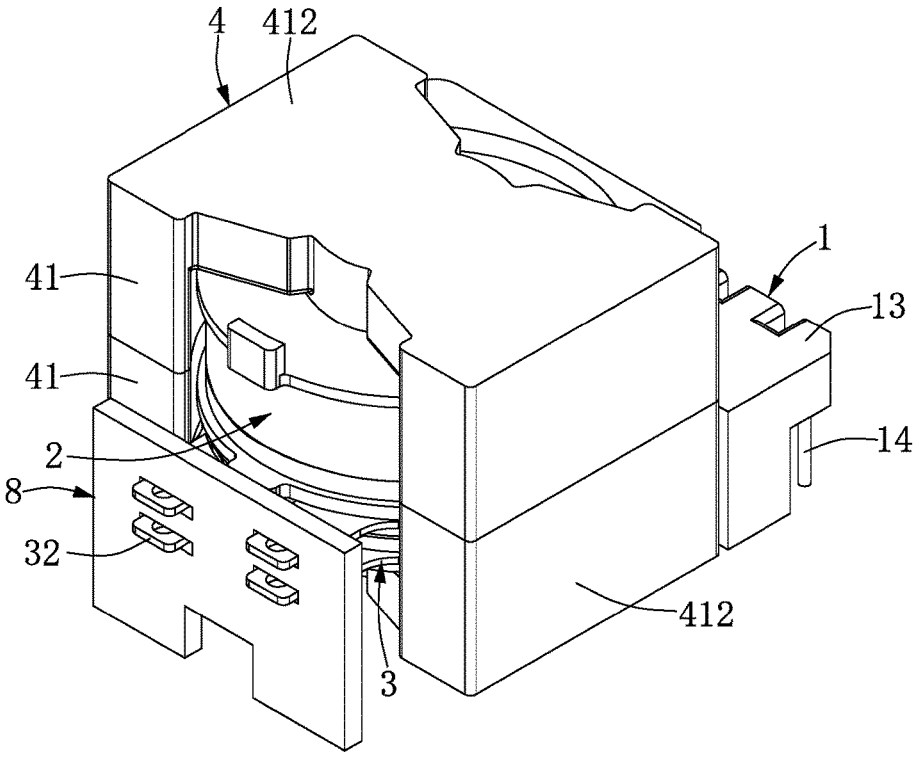
FIG. 8 is a three-dimensional assembly drawing of the second embodiment according to the transformer structure of the present disclosure.
Figure 9:
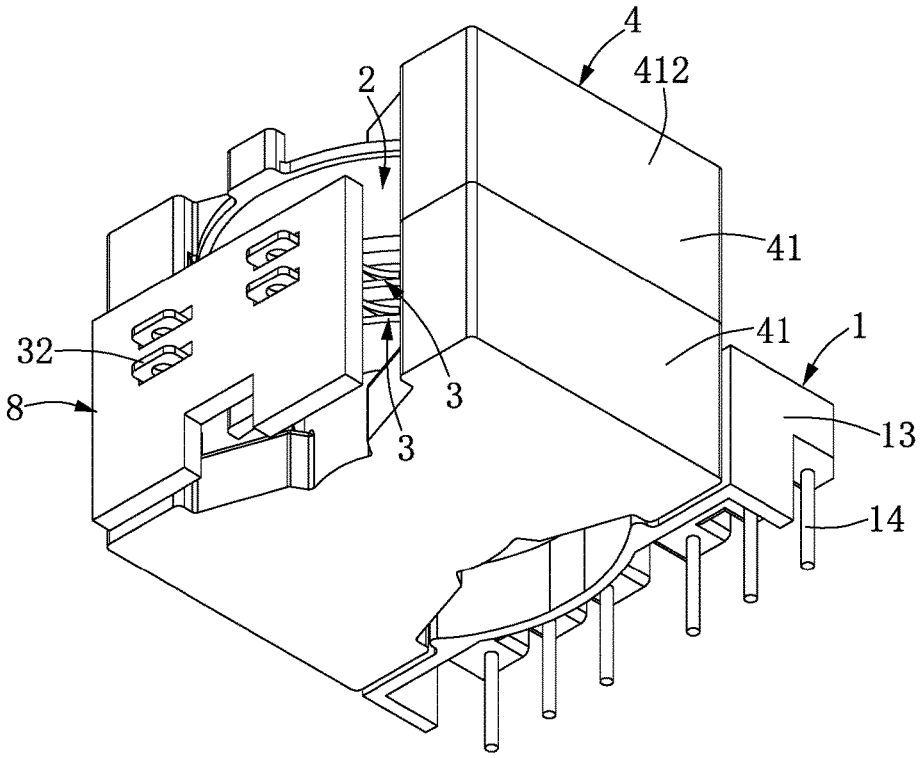
FIG. 9 is a three-dimensional assembly drawing of the second embodiment from another angle according to the transformer structure of the present disclosure.

An iron core set 4 is arranged on the winding stand 1, and the iron core set 4 passes internally through the first coil 2 and the two second coils 3. The structure of the winding stand 4 can change according to the specification requirements without limitation. In this embodiment, the iron core set 4 comprises two iron cores 41, arranged opposite to each other. The two iron cores 41 are arranged on the two sides of the winding portion 11 of the winding stand 1. The two iron cores 41 are provided with an internal iron core 411 and an external iron core 412 respectively, and a magnetic circuit is formed through connecting the internal iron core 411 and the external iron core 412. The internal iron cores 411 of the two iron cores 41 pass through the internal of the first coil 2 and the two second coils 3; i.e., the internal iron core 411 of the iron cores 41 can pass through the first boring 12 of the first coil 2 and the second boring 311 of the second coil 3. The outer iron cores 412 of the two iron cores 41 are arranged on the outer edge of the first coil 2 and the two second coils 3, thereby forming an integrated transformer structure (as shown from FIG. 3 to FIG. 5).

Second Embodiment

Please refer to FIG. 6 to FIG. 9. The embodiment is almost the same as the first embodiment, the difference being that the two second coils 3 are arranged on the same side of the winding portion 11 of the winding stand 1; in other words, the two coils 3 are arranged adjacently, and a second insulating layer 5 is arranged between the two second coils 3. The embodiment is an asymmetric assembly method of the primary and secondary sides, so that leakage inductances of the secondary sides may differ from each other, and a second insulating layer 5 is needed to be arranged between the two secondary side winding sets.

Furthermore, an insulating tape 6 is arranged at the outer edge of the winding portion 11, with the outer edge being close to the two second coils 3; i.e., the insulating tape 6 is taped and set on the one near side of the outer edge of the winding portion 11 of the winding stand 1. The insulating tape 6 is arranged between the first coil 2 and the two second coils 3, to increase the insulating efficiency; and the variation in thickness of the insulating tapes 6 can be further used to adjust the distance between the first coil 2 and the second coils 3.

In the transformer structure according to the present disclosure, the first coil (the primary side coil) can be coupled to the circuit board directly through the first pins 14, to replace the fly line method, thereby improving the efficiency of the factory processing. On the other hand, the second coil (the secondary side coil) can be wound with a metal sheet (such as a copper sheet) having electrical conductivity. A positioning mechanism can be further arranged to secure the second coil. Compared with the common winding using general copper wires or multiple strand wires, this method can reduce DC Resistance (DCR) significantly so that the power consumption is reduced and the temperature rise problem can be improved.

Specifically, regarding the winding portion according to the present disclosure, the secondary side winding DCR can be reduced significantly, improving the efficiency for developing power supplies with high wattage as well as improving the temperature rise problem of transformers, and resulting in compliance with the regulations of 80 plus high efficiency model. For example, regarding the regulation of the safety standard for magnetic elements at 110 degrees, take the power supply with 400 W for example. The secondary side coil of the transformer is wound and made with 350 stranded wires; the winding defined by the DCR specification is 2 mΩ max, and the real measurement is 1.5 mΩ. For the transformer with the secondary side coil made with a copper sheet, its winding defined by the DCR specification is 0.9 mΩ max, therefore the transformer with the copper sheet has improved more than 40% in regards to the secondary side winding DCR. A significant improvement in the efficiency and the transformer temperature rise problem can be seen thereof. Therefore, the proposal of the transformer according to the present disclosure makes it possible for a power supply with high wattage to meet the regulation of safety of 80 plus at 110 degrees, and improves factory processing.

Taking the secondary side winding that uses a copper sheet in a transformer as an example. Validating this by adding 330 W 80 PLUS gold power supply, this disclosure found out that the efficiency of the transformer has improved in the range of 0.09% to 0.31%; and the temperature rise problem has been improved between 7 and 8° C. or so. The application of the transformer according to the present disclosure not only achieves the reduction of the transformer's power consumption and the improvement of the temperature rise problem, it also meets the relevant regulations in efficiency.

The above are the only preferable embodiments according to the present disclosure; they are not intended to limit the patent protection scope of the present disclosure. Equivalent changes made to the specification and drawings according to the present disclosure fall within the protection scope of the present disclosure, as is explained.

What is claimed is:

1. A transformer structure, comprising:

a winding stand, provided with a winding portion, only one pin seat is arranged on a bottom side edge of the winding portion, and a plurality of first pins are arranged on the pin seat;

a first coil, wound on the winding portion of the winding stand, and the first coil connects to the first pins electrically;

two second coils, being two metal sheets having electrical conductivity, the two second coils are provided with a ring body and two second pins respectively, the two second pins being connected to the ring body and coupled to a vertically arranged sub-circuit board which is an adapter board without any electronic components disposed thereon, the two second coils being respectively arranged on two opposite side surfaces of the winding portion of the winding stand; and an iron core set, arranged on the winding stand, and the iron core set passes internally through the first coil and the two second coils, wherein a positioning mechanism arranged between the winding portion of the winding stand and the two second coils comprises a first positioning portion and a second positioning portion, the first positioning portion and the second positioning portion are arranged on two opposite side edges of the winding portion of the winding stand, the first positioning portion contacts on sides of the second coils, and the second positioning portion contacts on the other sides of the second coils;

wherein the second positioning portion includes an upper board body and a lower board body that extend vertically in opposite directions from the winding portion and are arranged between the vertically arranged sub-circuit board and the second coils; and wherein a length of the lower board body is greater than that of the upper board body.

2. The transformer structure according to claim 1, wherein the ring body is arranged and wound spirally, the two second pins being connected to two sides of the ring body, a first insulating layer is arranged on an outer edge of the ring body, the ring body is flat, a cross section of the ring body is a rectangle, and a width of the cross section of the ring body is greater than its thickness.

3. The transformer structure according to claim 1, wherein the two second coils are arranged on the same side of the winding portion of the winding stand, the two second coils are arranged on an outer side of the winding portion of the winding stand, and a second insulating layer is arranged between the two second coils.

4. The transformer structure according to claim 1, wherein the two second coils are copper sheets or copper alloy sheets.

5. The transformer structure according to claim 1, wherein the first pins are parallel to a pivot direction of the winding stand, the second pins are perpendicular to the pivot direction of the winding stand, and the second pins are perpendicular to the first pins.

6. The transformer structure according to claim 1, wherein an insulating tape is arranged at an outer edge of the winding portion of the winding stand, with the outer edge being close to the two second coils, and the insulating tape is arranged between the first coil and the two second coils.

7. The transformer structure according to claim 1, wherein the iron core set comprises two iron cores, with the two iron cores arranged opposite to each other, the two iron cores are arranged on the two sides of the winding portion of the winding stand respectively, each of the two iron cores is provided with an inner iron core portion and an outer iron core portion, a magnetic circuit is formed through the connection of the inner iron core portion and the outer iron core portion, the inner iron core portions of the two iron cores pass internally through the first coil and the two second coils, the outer iron core portions of the two iron cores are disposed at the external of the first coil and the two second coils.

* * * * *